US005511784A

United States Patent [19]

Furry et al.

[11] Patent Number: 5,511,784

[45] Date of Patent: Apr. 30, 1996

[54] METHOD AND APPARATUS FOR DIRECTLY GENERATING A RANDOM FINAL OUTCOME OF A GAME

[75] Inventors: Kevin Furry; Jess Tode, both of Bozeman, Mont.

[73] Assignee: Video Lottery Technologies, Inc., Bozeman, Mont.

[21] Appl. No.: 239,755

[22] Filed: May 9, 1994

[51] Int. Cl.[6] ..... A63F 5/04

[52] U.S. Cl. ..... 273/143 R

[58] Field of Search ..... 273/138 A, 143 R; 364/410, 412

[56] References Cited

U.S. PATENT DOCUMENTS

| | | | |
|---|---|---|---|
| 4,448,419 | 5/1984 | Telnaes . | |
| 4,573,681 | 3/1986 | Okada . | |
| 4,711,451 | 12/1987 | Pajak et al. . | |
| 4,772,023 | 9/1988 | Okada . | |
| 4,858,932 | 8/1989 | Keane | 273/143 R |
| 5,050,881 | 9/1991 | Nagao | 273/143 R |
| 5,083,785 | 1/1992 | Okada | 273/143 R |
| 5,085,436 | 2/1992 | Bennett | 273/138 A |
| 5,102,134 | 4/1992 | Smyth . | |
| 5,102,137 | 4/1992 | Ekiert . | |
| 5,108,099 | 4/1992 | Smyth | 273/138 A |
| 5,127,651 | 7/1992 | Okada | 273/143 R |
| 5,152,529 | 10/1992 | Okada | 273/143 R |
| 5,169,147 | 12/1992 | Hamano | 273/138 A |
| 5,209,479 | 5/1993 | Nagao et al. . | |

*Primary Examiner*—Jessica J. Harrison

*Attorney, Agent, or Firm*—Kokjer, Kircher, Bowman & Johnson

[57] ABSTRACT

An apparatus for directly determining an outcome of a game which identifies this outcome by displaying a series of indicia that correspond to the outcome. The apparatus includes a random number generator which generates a random number from a predetermined set thereof. The random number is scaled to obtain an outcome identifier from a set of outcome identifiers. The set of outcome identifiers are divided into a plurality of subsets, with each subset corresponding to one win/loss tier. The outcome identifier is evaluated to determine which of the outcomes it corresponds to by identifying the subset, into which it falls. Once the outcome is identified, a corresponding win/loss tier is identified. Each win/loss tier is associated with a unique reel combination table, each of which includes at least one series of indicia to be displayed as a reel combination corresponding to the chosen outcome. Once the win/loss tier is identified, the random number is again scaled to obtain an index into the corresponding reel combination table. The table is accessed and the indexed series of indicia are displayed.

33 Claims, 5 Drawing Sheets

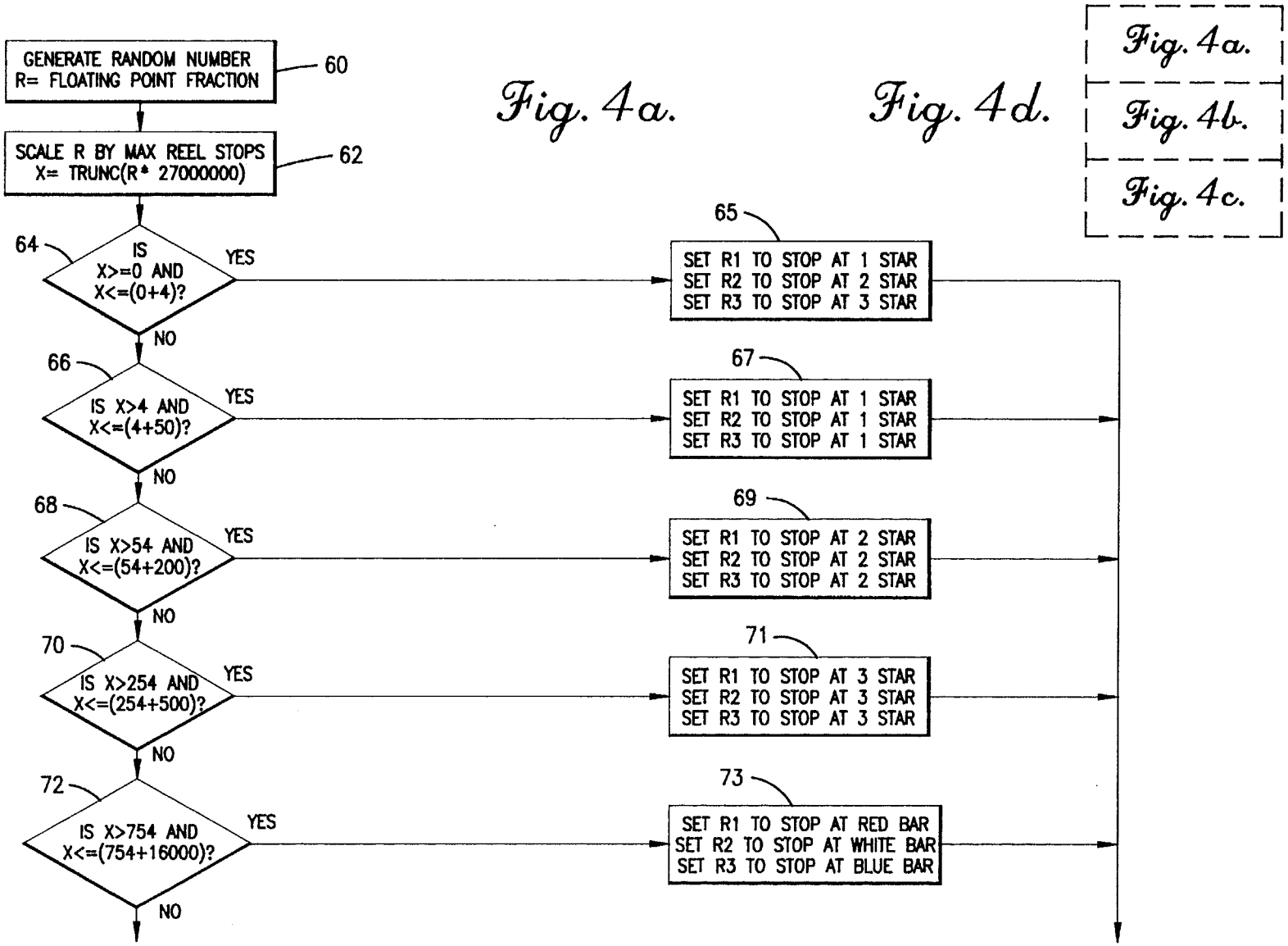
Fig. 4a.
Fig. 4b.
Fig. 4c.
Fig. 4d.
Fig. 4a.
60
GENERATE RANDOM NUMBER
R= FLOATING POINT FRACTION
62
SCALE R BY MAX REEL STOPS
X= TRUNC(R* 27000000)
64
IS
X>=0 AND
X<=(0+4)?
YES
NO
65
SET R1 TO STOP AT 1 STAR
SET R2 TO STOP AT 2 STAR
SET R3 TO STOP AT 3 STAR
66
IS X>4 AND
X<=(4+50)?
YES
NO
67
SET R1 TO STOP AT 1 STAR
SET R2 TO STOP AT 1 STAR
SET R3 TO STOP AT 1 STAR
68
IS X>54 AND
X<=(54+200)?
YES
NO
69
SET R1 TO STOP AT 2 STAR
SET R2 TO STOP AT 2 STAR
SET R3 TO STOP AT 2 STAR
70
IS X>254 AND
X<=(254+500)?
YES
NO
71
SET R1 TO STOP AT 3 STAR
SET R2 TO STOP AT 3 STAR
SET R3 TO STOP AT 3 STAR
72
IS X>754 AND
X<=(754+16000)?
YES
NO
73
SET R1 TO STOP AT RED BAR
SET R2 TO STOP AT WHITE BAR
SET R3 TO STOP AT BLUE BAR

METHOD AND APPARATUS FOR DIRECTLY GENERATING A RANDOM FINAL OUTCOME OF A GAME

BACKGROUND OF THE INVENTION

1. Field of the Invention

The invention generally relates to an electronic gaming apparatus, such as a slot machine, which displays combinations of indicia to identify a game's outcome.

2. Description of the Related Art

Conventional gaming devices have been proposed which include a plurality of reels that rotate about a common axis and include indicia (such as fruit, bars, stars and the like) about their peripheries that are used to indicate the stopping position of each reel. These reels are rotatably activated by pulling a lever and are stopped randomly to define a game outcome. As each stopping position upon each reel was randomly defined, the odds of each potential outcome were the same, namely 1:N (where N represents the total number of possible indicia combinations). Thus, if each reel included 22 indicia about its periphery and the gaming device included three reels, the total number of possible combinations N equaled $22^3$ or 10,648.

However, as the demand increased to provide larger jackpots, the need arose for gaming devices capable of generating outcomes having a lower probability of occurring (such as 1:1,000,000). To increase the odds in thee conventional mechanical gaming devices, it is necessary to include either additional reels or more indicia (e.g. stopping positions) upon each reel.

Alternative gaming devices have been proposed (such as in U.S. Pat. No. 4,448,419) which utilize "virtual reels" to increase the odds of a particular outcome without increasing the number and size of reels. The gaming device of the '419 patent includes a standard number of reels with an ordinary number of indicia thereon (e.g. 3 reels with 22 positions per reel). These standard reels provide the typical number of potential physical outcomes (e.g. 10,648). Additionally, this virtual reel type gaming device includes a random number generator capable of computing a random number for each reel from a small set of numbers (e.g. 1 to 100). Each number within the random number set represents a virtual reel position, and thus the combination of each set of virtual reel positions produces a gaming device having an extremely large number of stopping points or outcomes (e.g. 1 to 1,000,000). Hence, the final combination of virtual reel outcomes, has an extremely low probability of occurrence (e.g. 1:1,000,000 in the current example).

The virtual reel type gaming device of the '419 patent further includes virtual reel tables for each standard reel, in which each virtual reel position is assigned to an actual/physical position upon each standard reel. In the example, a standard reel includes 22 positions while the virtual reel includes 100. Thus, multiple positions within the virtual reel are assigned to the same position upon the actual reel. This virtual reel table provides a mechanism for varying the odds of occurrence for an actual reel position by assigning different numbers of virtual reel positions to each actual reel position. For instance, a jackpot "bar" upon the actual reel may be assigned to one virtual reel position (i.e. one random number).

During operation, the virtual reel type gaming machine obtains a number from the random number generator and uses this number as an index into the virtual reel table to obtain a corresponding actual reel position. Thereafter, the standard physical reel within the gaming machine is stopped at the indexed actual reel position. This process was repeated for every reel within the machine, after which the outcome is determined from the chosen reel positions.

However, the virtual reel type gaming machines include inherent limitations. First, the machine must include sufficient memory to store the virtual reel table. Thus, as the demand increases for larger payouts with lower probabilities of occurrence, the size of the virtual reel table will increase along with memory requirements therefor. Additionally, once the virtual reel table is established, it is not amenable to updates without completely rewriting the table. For instance, in the virtual reel table of the '419 patent, consecutive random numbers are assigned to each actual reel position. Thus, if the system is modified to change the number of actual positions upon the reel or to change the tonal number of virtual positions, the entire virtual reel table must be rewritten.

Further, these conventional gaming devices require the virtual reel table to be rewritten when it is desirable to change the odds of a particular reel occurrence. Finally, as the market for gaming devices changes, it is desirable to add extra indicia combinations to existing reels and to add more reels with new indicia. These additions extend beyond the capabilities of the virtual reel systems. Also, the market for gaming devices now requires more than one set of virtual reels to be contained within each computer. As these additions arise, they further increase the memory requirements of the gaming machine.

The need remains in the industry for an improved design and implementation technique to address the problems and drawbacks heretofore experienced. The primary objective of this invention is to meet this need.

SUMMARY OF THE INVENTION

It is an object of the present invention to increase the capability of a gaming machine to include more and different reel indicia combinations without increasing the physical size of the reels and without substantially increasing the memory requirements of the device.

It is a further object of the present invention to provide a gaming device on which the reel indicia combinations are easily designed and on which many different game dynamic designs can be offered within a single standard device.

It is another object of the present invention to remove the need for large memory tables.

It is another object of the present invention to provide a gaming device, in which the odds of a winning combination may be modified without modifying any tables within memory.

It is a further object of the present invention to provide a gaming device which generates complete outcomes based directly upon a single randomly generated number.

In summary, the system includes an apparatus for directly determining an outcome of a game. The apparatus identifies this outcome by displaying a series of indicia that correspond to the outcome. The inventive apparatus includes a random number generator which generates a random number from a predetermined set thereof. The random number is scaled to obtain an outcome identifier from a set of outcome identifiers. The set of outcome identifiers are divided into a plurality of subsets, with each subset corresponding to one win/loss tier. The outcome identifier is evaluated to determine which of the outcomes it corresponds to by identifying the subset, into which it falls. Once the outcome is identified, a corresponding win/loss tier is identified. Each win/loss tier is associated with a unique reel combination table, each of which includes at least one series of indicia to be displayed as a reel combination corresponding to the chosen outcome. Once the win/loss tier is identified, the random number is again scaled to obtain an index into the corresponding reel combination table. The table is accessed and the indexed series of indicia are displayed.

BRIEF DESCRIPTION OF THE DRAWINGS

The objects and features of the invention noted above are explained in more detail with reference to the drawings, in which like reference numerals denote like elements, and in which:

FIGS. 4A–4D illustrate the processing sequence followed by the present invention to determine an outcome and, based thereon, determine the corresponding series of indicia to be displayed to a user.

DETAILED DESCRIPTION OF THE INVENTION

Figure 1:
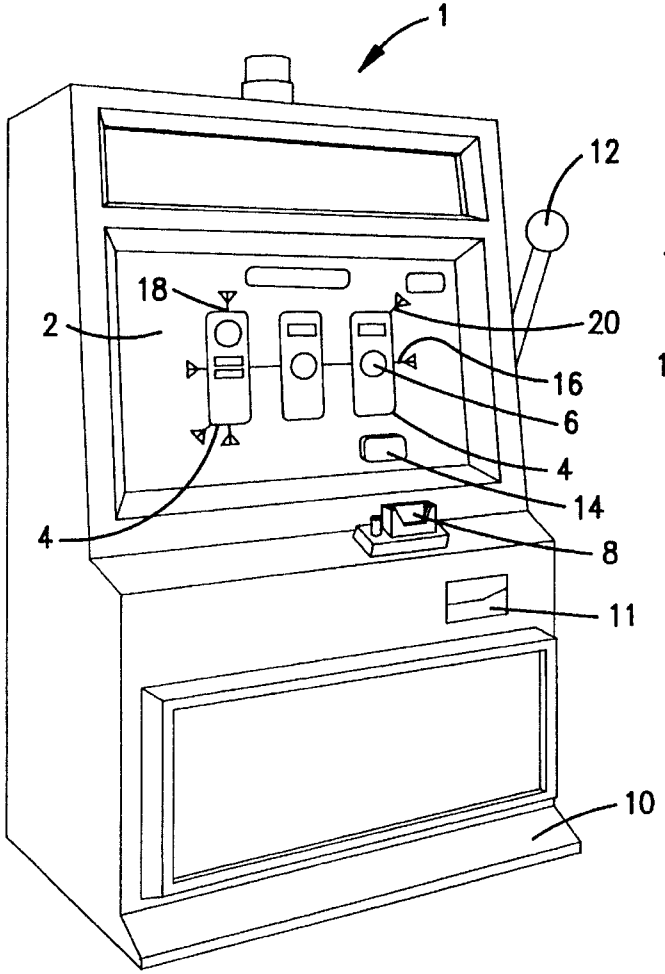
FIG. 1 illustrates a gaming device according to the preferred embodiment of the present invention.

FIG. 1 generally illustrates a gaming device, such as a slot machine 1, used to implement the present invention. The instant slot machine 1 includes a display screen 2 for displaying a graphic representation of a plurality of reels 4, each of which includes multiple indicia 6 fixed to its periphery. The indicia 6 may represent a variety of known items, such as fruit, colored bars, colored stars and the like. The display 2 may represent actual mechanical reels as used in conventional slot machines or video displays controlled to display simulated reels as graphical representations of mechanical reels. In a mechanical implementation, the reels may be stopped by conventional reel stopping mechanisms, and in a video display, the graphical representation of the indicia may be determined by software controlling the display image.

The slot machine 1 further includes a slot 8 for inserting tokens or currency, a bill acceptor 11, a change return 10 for returning change, and also a hopper for returning payouts for winning games. The slot machine 1 may include a handle 12 and/or buttons 14, ,either of which will initiate a new game once a coin or token has been inserted. The buttons 14 may be physically located within the housing or visually displayed on the screen, which may be touch sensitive.

Figure 5:
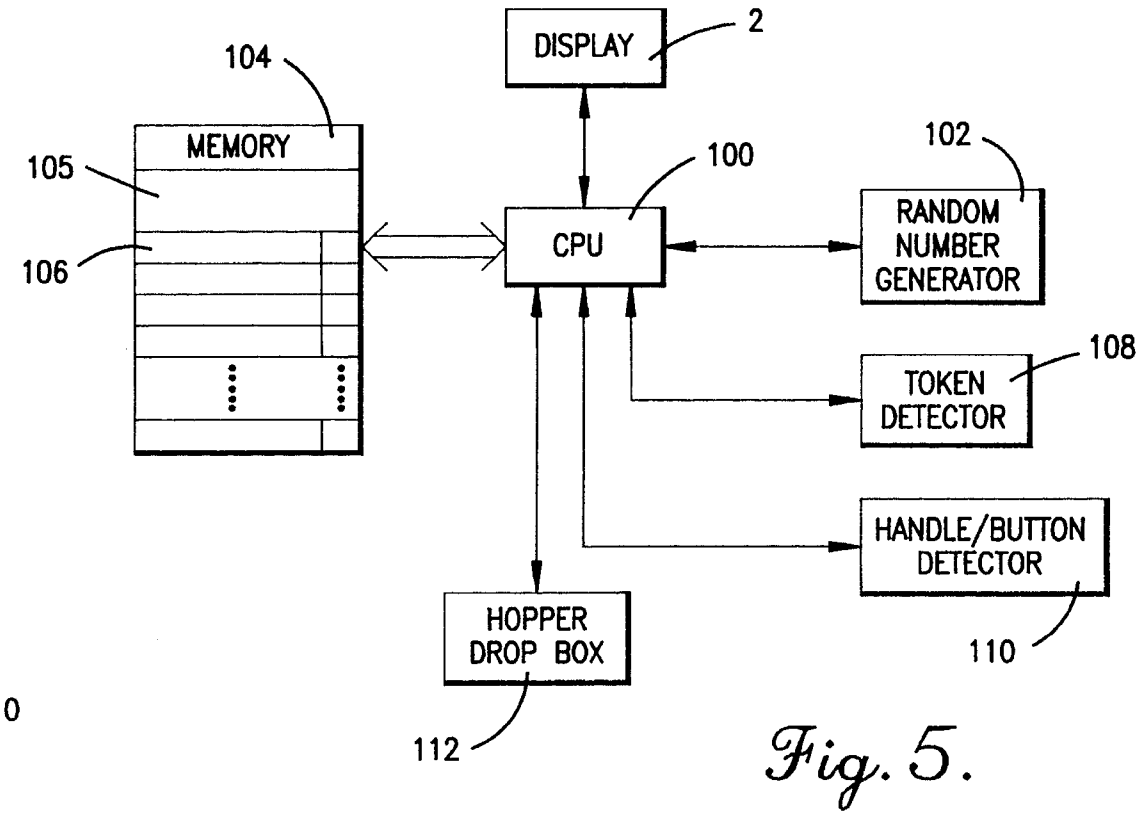
FIG. 5 illustrates a block diagram of the present invention.

As illustrated in FIG. 5, the slot machine includes a CPU 100 connected to the display 2 and a memory unit 104. The CPU 100 includes a random number generator 102 and controls operation of the system in accordance with the processing sequence of FIGS. 2–4, as explained hereafter. The random number generator (software algorithm) 102 produces a random number when requested by the CPU 100. The CPU 100 scales this random number to produce the outcome identifier for a particular game from the plurality of possible outcome identifiers. Each outcome corresponds to a win/loss tier. The memory 104 includes a list of upper and lower limits 105 defining each subset within the plurality of outcomes and corresponding win/less tiers. The CPU 100 accesses the limit list 105 to perform the comparison as described below to identify a selected win/loss tier. In this manner, the slot machine 1 need not store the entire list of possible outcomes, just the limits separating the possible outcomes into its respective subsets.

The memory unit 104 also stores reel combination tables 106, each of which correspond to one of the subsets and the corresponding win/loss tiers. Each table 106 includes one or more series of indicia to be displayed for a corresponding outcome, along with the amount of payout to be paid for this outcome. These tables 106 combine to store one copy of each possible combination of the reel indicia to be displayed, thereby minimizing the total information to be stored.

This arrangement is easily modified by merely adjusting the upper and lower limits 105 for each subset to redefine the odds for a particular win/loss tier and to add or subtract a win/loss tier. The displayed combinations of reel indicia are easily modified by merely modifying a specific series of indicia within a corresponding table. Similarly, entries may be added and subtracted from each table 106 without necessitating further modifications to the other tables. These tables 106 also present a single location and simple manner for adjusting the payout for a particular win/loss tier.

The CPU 100 further communicates with a token detector 108 which detects the insertion of new coins or tokens, a handle/button detector 110 that detects the activation of the handle 12 or buttons 14, and a hopper drop box controller 112 which controls payouts to the hopper.

Figure 2:
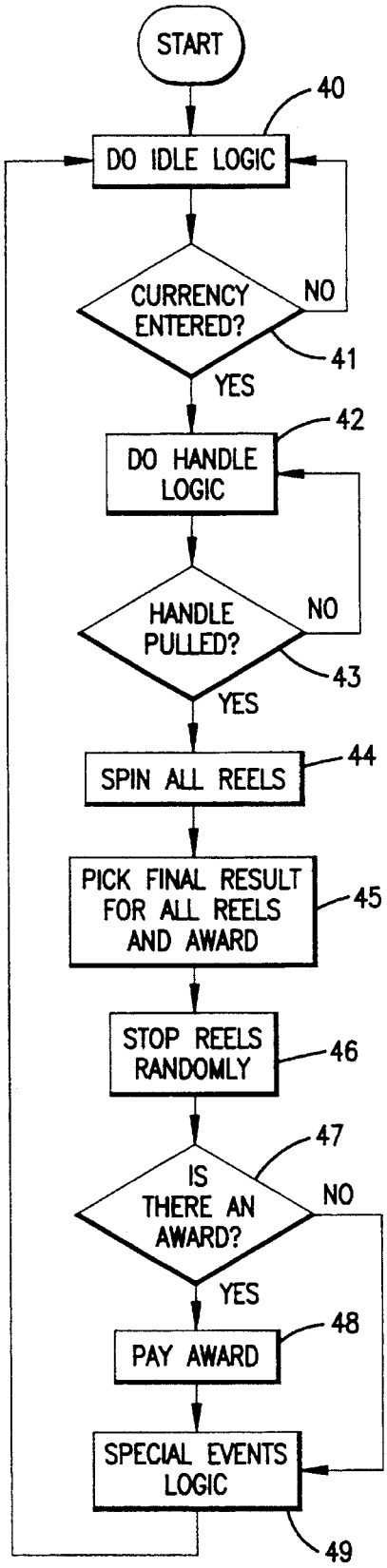
FIG. 2 illustrates an overall flowchart showing the processing sequence for controlling operation of the gaming device of FIG. 1.

Turning to FIG. 2, the general operation of the slot machine 1 is described hereafter. Once the slot machine is turned on, it remains in an idle logic loop (steps 40 and 41) until a coin or token is inserted. Once a token or currency is entered, it is passed to a storage or payout device, such as a hopper, a bill box or a token drop box, with the appropriate one being identified by the computer. Once a coin or token is detected (step 41) by a coin detector, the CPU moves control to a start event waiting loop (steps 42 and 43), at which the device waits until the handle 12 is pulled or a button 14 is pushed. Once the handle 12 is pulled or the button is pushed, the video display 2 is activated to simulate graphically spinning reels (step 44). In a mechanic embodiment, reels are spun. Thereafter, a random number generator is activated to chose directly and randomly a final outcome for the game (step 45). In step 45, after the final outcome is chosen, a corresponding reel combination table is accessed to obtain a series of indicia to be graphically displayed on the reels 4 to identify the chosen outcome. Thereafter, the simulated spinning reels are stopped (step 46) and the obtained series of indicia are displayed. The display 2 may be controlled to display winning series of indicia along a horizontal line 16, a vertical line 18 and/or any combination of visible reel positions.

If the directly generated outcome corresponds to an award or payout (step 47), a payout device within the slot machine 1 is activated to distribute the payout (step 48). Thereafter the computer may initiate an event 49 for special effects such as lights or audio reward devices. In addition the special events logic may produce a change to the indicia displayed on the reels by repositioning the reels, provide additional payout from a payout device such as the hopper, or in turn initiate additional processes that result in a change to the indicia displayed on the reels.

Figure 3:
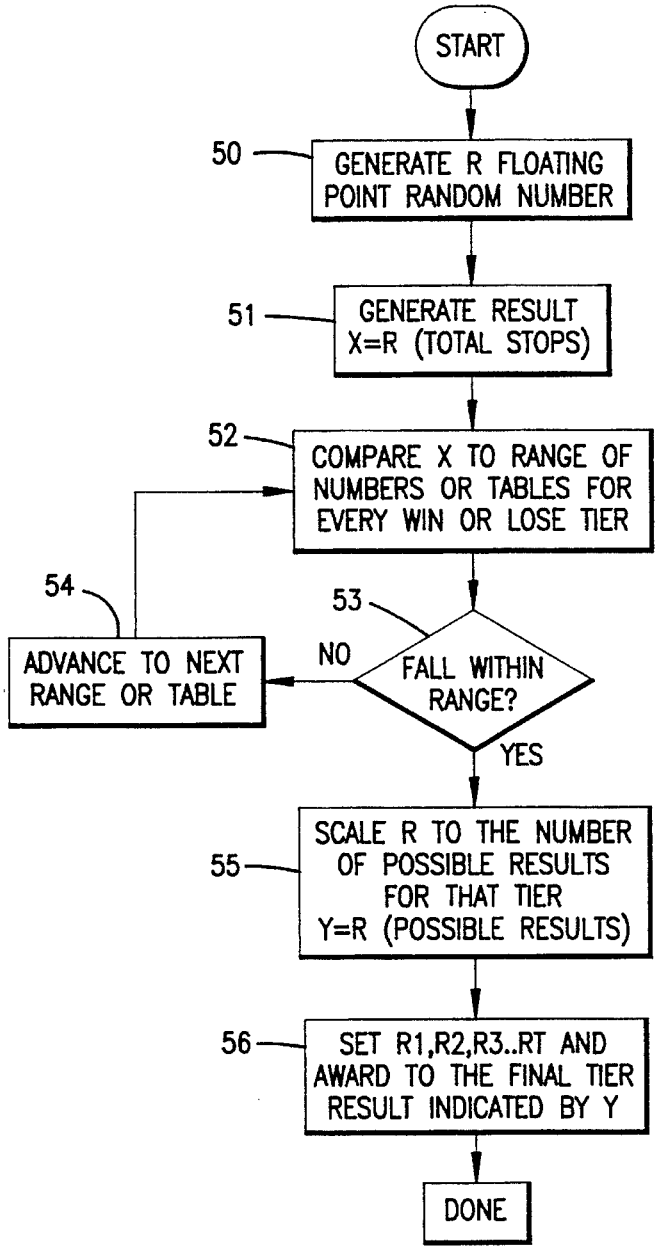
FIG. 3 illustrates a flowchart used by the present invention to determine an outcome of a game.

FIG. 3 illustrates in more detail the processing sequence which occurs within step 45 of FIG. 2. Once step 45 is entered, a random number is generated (step 50) from a predetermined set of numbers, such as a set of floating point numbers. Thereafter, the random number is scaled/converted (step 51) to an integer directly identifying the outcome of the game. As an example, this conversion may be effected according to the following equation: X=TRUNC(R*27,000,000), where R equals the floating point random number and X equals an outcome identifier identifying the game's outcome. In this manner, the random number is scaled by the maximum number of potential outcomes (e.g. 27,000,000).

The range of potential outcomes is separated into multiple subsets defined by upper and lower integer limits. Each subset corresponds to a particular win/loss tier. Each win/loss tier corresponds to a different payout (including no payout for a loss tier) having a different probability of occurrence. The probability of occurrence for each subset is determined by the number of outcome identifiers included between the upper and lower limits for the subset. This probability is set depending upon the size of the payout for the corresponding win/loss tier. For instance, if the highest payout or win/loss tier corresponds to a $100,000,000 payout, the probability of occurrence for the highest payout would be extremely small.

In step 52, the generated outcome identifier is compared with the upper and lower limits of a first or current subset to identify the corresponding win/loss tier. If the generated outcome identifier does not fall within the first or current subset then it does not identify the current win/loss tier (step 53). Thus, the process advances to the next set of upper and lower limits for the next subset or win/loss tier (step 54). Thereafter, step 52 is repeated and the outcome identifier is compared with the next/current subset. This process is repeated until a set of upper and lower subset limits are found that the outcome identifier falls within. Once a subset match is obtained, the corresponding win/loss tier is identified along with the corresponding reel combination table. Next, the generated random number is again scaled (step 55) to identify the series of reel indicia to be displayed for the chosen outcome.

In step 55, the scaled random number creates an index into the chosen reel combination table. For instance, this index may be obtained in accordance with the following equation: Y=R#; where R equals the floating point random number generated above and the # represents the number of possible reel combinations within the reel combination table corresponding to the identified subset and win/loss tier, and the Y equals the index into the corresponding reel combination table. Once the reel table index Y is obtained, it is used to access a series of indicia corresponding to the identified outcome. The indexed series of indicia are read (step 56) and the payout award corresponding to the resulting win/loss tier is obtained (step 56). Thereafter, control returns to step 46 in FIG. 2 at which the reels are stopped and the award is paid out.

Hereafter, a system is described by way of example only, and is not intended to limit the present invention in any way. In this example, a slot machine is provided with three reels, each of which includes seven unique indicia (e.g. a one star, two star, three star, red bar, white bar, blue bar and space as illustrated in Table 2 below). In the exemplary system, the payout tier structure is set up as illustrated below in Table 1 with 14 winning tiers and 1 losing tier. The highest payout corresponds to the reel combination one star on the 1st reel, two star on the 2nd reel, three star on the 3rd reel. The lowest tier corresponding to a payout will display any bar on all three reels.

TABLE 1

| PAY TIER MATCH | | | ODDS | MATCHES | WIN |
|---|---|---|---|---|---|
| | | | | 27000000 | |
| 1 Star | 2 Star | 3 Star | 5400000 | 5 | 2000 |
| 1 Star | 1 Star | 1 Star | 540000 | 50 | 1000 |
| 2 Star | 2 Star | 2 Star | 135000 | 200 | 750 |
| 3 Star | 3 Star | 3 Star | 54000 | 500 | 500 |
| Red Bar | White Bar | Blue Bar | 1687.5 | 16000 | 100 |
| Red Bar | Red Bar | Red Bar | 450 | 60000 | 75 |
| White Bar | White Bar | White Bar | 168.75 | 160000 | 30 |
| Blue Bar | Blue Bar | Blue Bar | 135 | 200000 | 20 |
| Any Red | Any White | Any Blue | 1254.6468401487 | 21520 | 10 |
| Any Red | Any Red | Any Red | 1298.0769230769 | 20800 | 5 |
| Any White | Any White | Any White | 314.68531468531 | 85800 | 5 |
| Any Blue | Any Blue | Any Blue | 170.61611374408 | 158250 | 5 |
| Any Star | Any Star | Any Star | 1955.8131111916 | 13805 | 240 |
| Any Bar | Any Bar | Any Bar | 4.4672402382528 | 6044000 | 1 |
| Any Lose | Any Lose | Any Lose | 1.3353729919329 | 20219070 | 0 |

As illustrated in Table 1, the set of outcome identifiers includes 27,000,000 potential outcomes, five of which are assigned to identify the first winning tier for the highest payout.

Table 1 illustrates each win/loss payout tier, along with its corresponding odds and the number of outcome identifiers matching that win/loss tier. Table 1 further illustrates the payout amount associated with each win. The first eight win/loss tiers each correspond to a single unique specific reel combination. In such a circumstance, only one combination would be displayed regardless of which outcome resulted that corresponded to the tier. The lower six winning tiers correspond to multiple possible reel combinations. Table 2 illustrates the actual reel strip layouts for each reel according to this example.

TABLE 2

| REEL STRIP 1 | REEL STRIP 2 | REEL STRIP 3 |
|---|---|---|
| 1 RED STAR | 1 RED STAR | 1 RED STAR |
| 2 WHITE STARS | 2 WHITE STARS | 2 WHITE STARS |
| 3 BLUE STARS | 3 BLUE STARS | 3 BLUE STARS |
| RED BAR | RED BAR | RED BAR |
| WHITE BAR | WHITE BAR | WHITE BAR |
| BLUE BAR | BLUE BAR | BLUE BAR |
| SPACE | SPACE | SPACE |

Tables 3–8 illustrate every possible reel combination for the lower six winning tiers.

TABLE 3

| REEL STRIP 1 | REEL STRIP 2 | REEL STRIP 3 |
|---|---|---|
| 1 RED STAR | 2 WHITE STARS | BLUE BAR |
| 1 RED STAR | WHITE BAR | 3 BLUE STARS |
| 1 RED STAR | WHITE BAR | BLUE BAR |
| RED BAR | 2 WHITE STARS | 3 BLUE STARS |
| RED BAR | 2 WHITE STARS | BLUE BAR |
| RED BAR | WHITE BAR | 3 BLUE STARS |

TABLE 4

| REEL STRIP 1 | REEL STRIP 2 | REEL STRIP 3 |
|---|---|---|
| 1 RED STAR | 1 RED STAR | RED BAR |
| 1 RED STAR | RED BAR | 1 RED STAR |
| 1 RED STAR | RED BAR | RED BAR |
| RED BAR | 1 RED STAR | 1 RED STAR |
| RED BAR | 1 RED STAR | RED BAR |
| RED BAR | RED BAR | 1 RED STAR |

TABLE 5

| REEL STRIP 1 | REEL STRIP 2 | REEL STRIP 3 |
|---|---|---|
| 1 WHITE STAR | 1 WHITE STAR | WHITE BAR |
| 1 WHITE STAR | WHITE BAR | 1 WHITE STAR |
| 1 WHITE STAR | WHITE BAR | WHITE BAR |
| WHITE BAR | 1 WHITE STAR | 1 WHITE STAR |
| WHITE BAR | 1 WHITE STAR | WHITE BAR |
| WHITE BAR | WHITE BAR | 1 WHITE STAR |

TABLE 6

| REEL STRIP 1 | REEL STRIP 2 | REEL STRIP 3 |
|---|---|---|
| 1 BLUE STAR | 1 BLUE STAR | BLUE BAR |
| 1 BLUE STAR | BLUE BAR | 1 BLUE STAR |
| 1 BLUE STAR | BLUE BAR | BLUE BAR |
| BLUE BAR | 1 BLUE STAR | 1 BLUE STAR |
| BLUE BAR | 1 BLUE STAR | BLUE BAR |
| BLUE BAR | BLUE BAR | 1 BLUE STAR |

TABLE 7

| REEL STRIP 1 | REEL STRIP 2 | REEL STRIP 3 |
|---|---|---|
| 1 RED STAR | 1 RED STAR | 2 WHITE STARS |
| 1 RED STAR | 1 RED STAR | 3 BLUE STARS |
| 1 RED STAR | 2 WHITE STARS | 1 RED STAR |
| 1 RED STAR | 2 WHITE STARS | 2 WHITE STARS |
| 1 RED STAR | 3 BLUE STARS | 1 RED STAR |
| 1 RED STAR | 3 BLUE STARS | 2 WHITE STARS |
| 1 RED STAR | 3 BLUE STARS | 3 BLUE STARS |
| 2 WHITE STARS | 1 RED STAR | 1 RED STAR |
| 2 WHITE STARS | 1 RED STAR | 2 WHITE STARS |
| 2 WHITE STARS | 1 RED STAR | 3 BLUE STARS |
| 2 WHITE STARS | 2 WHITE STARS | 1 RED STAR |
| 2 WHITE STARS | 2 WHITE STARS | 3 BLUE STARS |
| 2 WHITE STARS | 3 BLUE STARS | 1 RED STAR |
| 2 WHITE STARS | 3 BLUE STARS | 2 WHITE STARS |
| 2 WHITE STARS | 3 BLUE STARS | 3 BLUE STARS |
| 3 BLUE STARS | 1 RED STAR | 1 RED STAR |
| 3 BLUE STARS | 1 RED STAR | 2 WHITE STARS |
| 3 BLUE STARS | 1 RED STAR | 3 BLUE STARS |
| 3 BLUE STARS | 2 WHITE STARS | 1 RED STAR |
| 3 BLUE STARS | 2 WHITE STARS | 2 WHITE STARS |
| 3 BLUE STARS | 2 WHITE STARS | 3 BLUE STARS |
| 3 BLUE STARS | 3 BLUE STARS | 1 RED STAR |
| 3 BLUE STARS | 3 BLUE STARS | 2 WHITE STARS |

TABLE 8

| REEL STRIP 1 | REEL STRIP 2 | REEL STRIP 3 |
|---|---|---|
| RED BAR | RED BAR | WHITE BAR |
| RED BAR | RED BAR | BLUE BAR |
| RED BAR | WHITE BAR | RED BAR |
| RED BAR | WHITE BAR | WHITE BAR |
| RED BAR | BLUE BAR | RED BAR |
| RED BAR | BLUE BAR | WHITE BAR |
| RED BAR | BLUE BAR | BLUE BAR |
| WHITE BAR | RED BAR | RED BAR |
| WHITE BAR | RED BAR | WHITE BAR |
| WHITE BAR | RED BAR | BLUE BAR |
| WHITE BAR | WHITE BAR | RED BAR |
| WHITE BAR | WHITE BAR | BLUE BAR |
| WHITE BAR | BLUE BAR | RED BAR |
| WHITE BAR | BLUE BAR | WHITE BAR |
| WHITE BAR | BLUE BAR | BLUE BAR |
| BLUE BAR | RED BAR | RED BAR |
| BLUE BAR | RED BAR | WHITE BAR |
| BLUE BAR | RED BAR | BLUE BAR |
| BLUE BAR | WHITE BAR | RED BAR |
| BLUE BAR | WHITE BAR | WHITE BAR |
| BLUE BAR | WHITE BAR | BLUE BAR |
| BLUE BAR | BLUE BAR | RED BAR |
| BLUE BAR | BLUE BAR | WHITE BAR |

By way of example, assume that an outcome is randomly chosen which corresponds to the ninth winning tier (i.e. any red, any white and any blue). The CPU will identify it as such and the ninth reel combination table (Table 3) will be accessed. The ninth win/loss tier, having a winning odds of 1:1254.647, corresponds to 21520 matching outcome identifiers and pays 10 times the bet. Similarly, if the randomly selected outcome is chosen to be within the 14th winning tier (e.g. any bar, any bar and any bar), then Table 8 will be accessed to identify a reel combination corresponding to the chosen outcome.

Figure 4B:
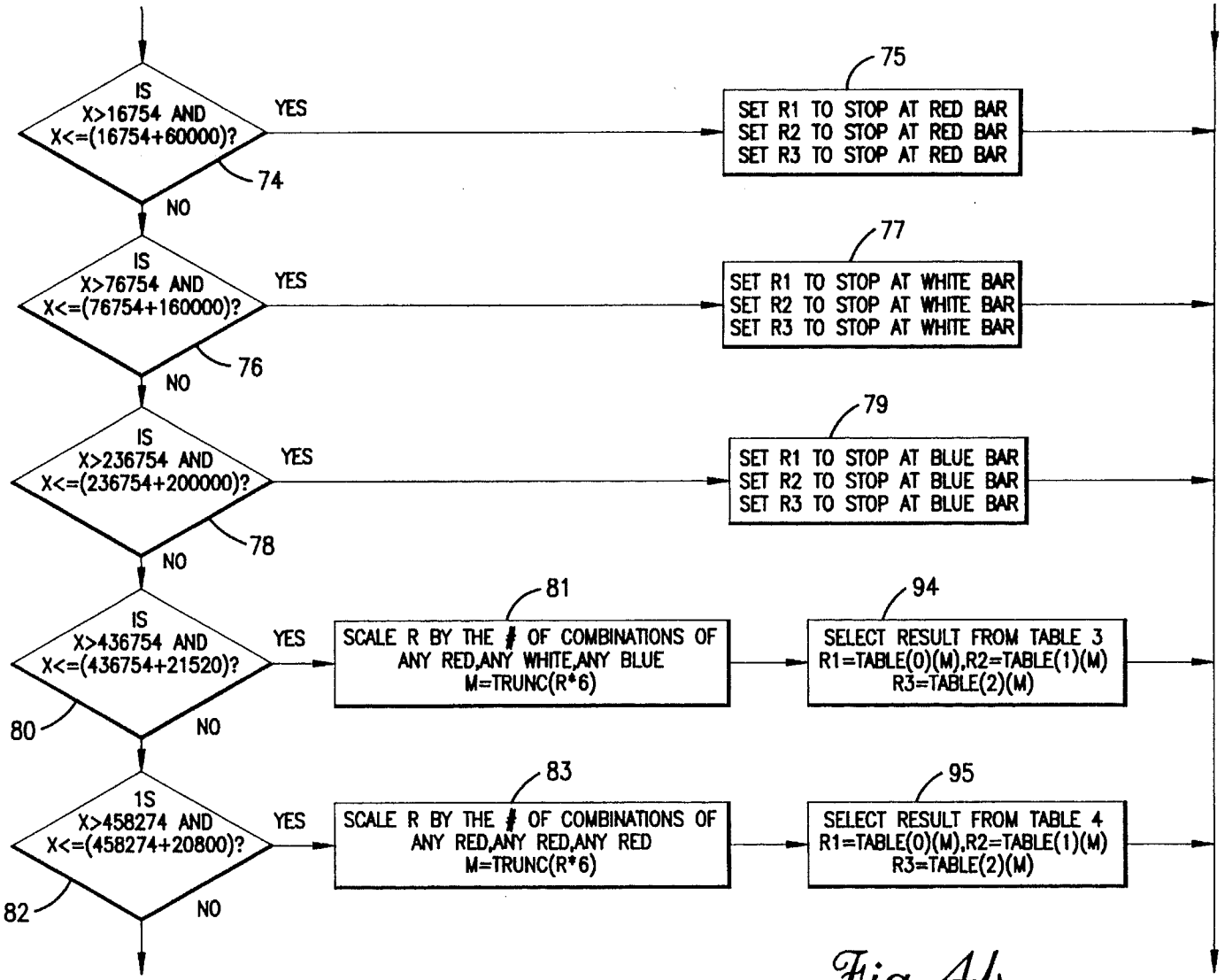
Figure 4C:
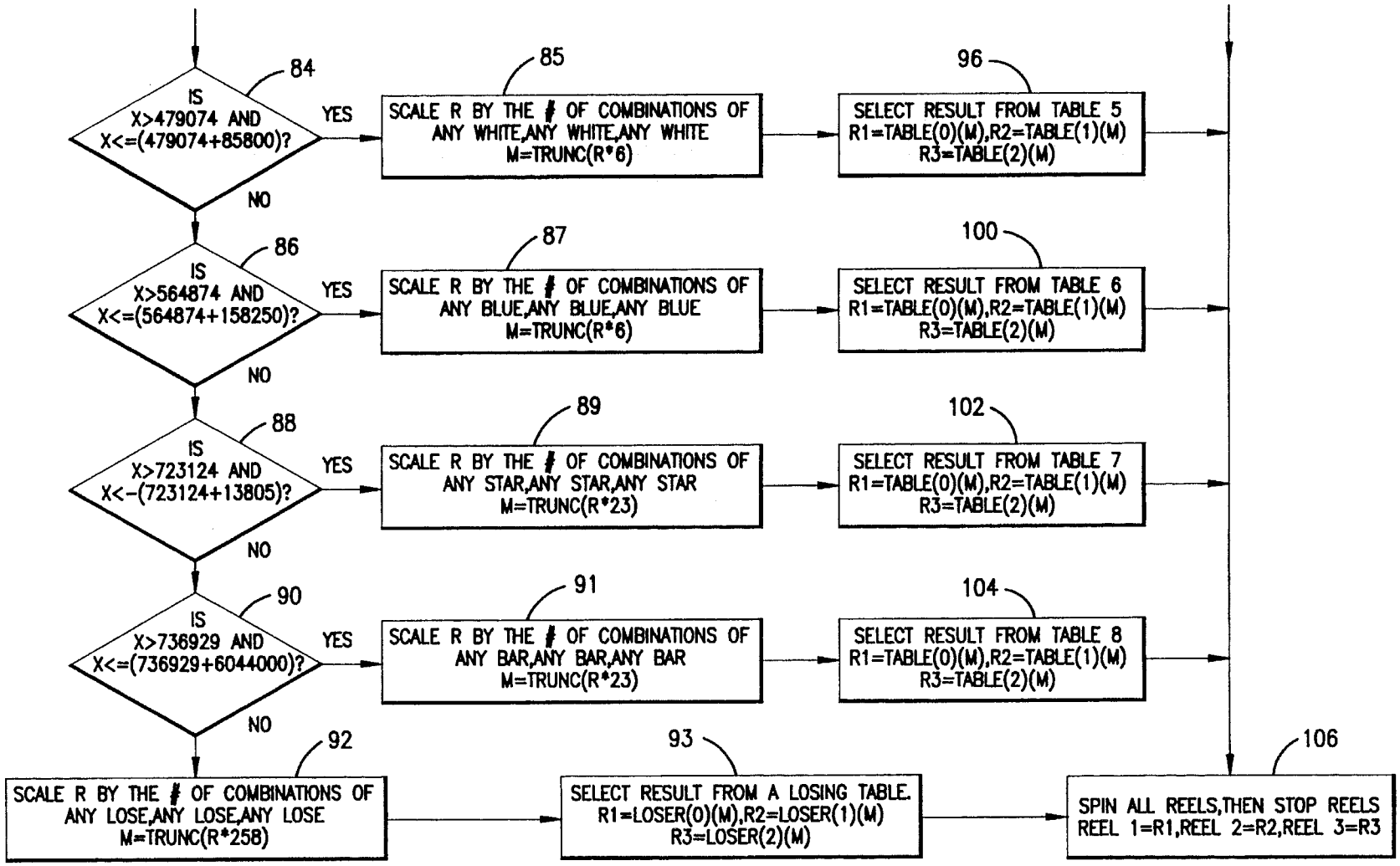

FIGS. 4A and 4C illustrate the specific exemplary processing sequence to be performed within step 45 of FIG. 2 in accordance with the payout tier structure illustrated in Tables 1–8. When processing reaches step 45, a random number R is generated (step 60 of FIG. 4A) and it is truncated by the maximum reel stops (27,000,000 in this example) in step 62. For purposes of this example, assume that the outcome identifier X falls within the subset corresponding to an outcome in the twelfth winning tier (e.g. any blue, any blue and any blue). In this case, the outcome identifier is compared in steps 64–84 without finding a match between the generated outcome identifier and the upper and lower subset limits.

However, in step 86, the generated outcome identifier is determined to fall within the range of the subset corresponding to the twelfth win/loss tier and thus processing flows to step 87. In step 87, the originally generated random number R is scaled by the number of potential combinations corresponding to the selected tier (i.e. six). Outcomes having a payout within the twelfth tier correspond to reel combinations within Table 6. Thus, in step 87, an index M is obtained identifying one of the six possible reel combinations in Table 6. This index is utilized in step 100 to obtain values for each reel R1, R2 and R3. For instance, if the index M equals four, then the reel combination one blue bar, one blue star and one blue star will be displayed upon the reels 4 in the display 2. These indicia will be displayed in step 106.

As a second example, assume that the generated random outcome X corresponds to a payout within the third tier. If so, again referring to FIG. 4A, the generated outcome identifier will be identified in step 68 as corresponding to the subset of potential outcome identifiers for the third tier.

Responsive thereto, control will pass to step 69 at which the reel combination is set to the single combination corresponding to the third tier (e.g. two star, two star and two star).

A specific table has not been illustrated which corresponds to all of the possible losing reel combinations since a substantially greater number of reel combinations would fall within such a table. Suffice it to say that all remaining reel combinations, not shown above, would fall within one or more losing reel combination tables.

Throughout the detailed description the losing combinations have been referred to as single group or as being provided within a single table. However, this need not be the case. Instead, the losing tier may be also segmented into sub-sets, with each subset being assigned to a unique group of losing reel combinations. In this instance, at step 90, if it is determined that the outcome identifier does not correspond to a winning tier, the outcome identifier would be compared to upper and lower limits of losing sub-sets. Once a corresponding losing sub-set is identified, the assigned table of losing reel combinations is accessed to determine the reel combination to be displayed. Thus, the invention contemplates any number of winning and losing tiers/combinations to check.

The above discussion is intended to illustrate the present invention by way of example only and is not intended to be limiting. The disclosed embodiment could be modified in a variety of ways. For instance, the illustrated reel combinations corresponding to a chosen outcome are displayed horizontally along line 16. Clearly, these tables could be modified to display corresponding reel combinations along the horizontal, vertical and/or any combination of visible reel positions.

Further, the invention may display one or more than one reel combinations to identify a randomly generated outcome. For instance, a particular outcome could be assigned to more than one tier, with the assigned tiers being ordered in a predetermined priority dictating the order to be displayed to the user. The order of priority would be independent of the amount of the payout such that the first displayed outcome may or may not pay more than the second outcome. This embodiment would be useful with slot machines which provide a user with a second chance to update or improve a result of a game by pushing a button to re-activate one or more of the reels once an initial result has been displayed.

During operation, once the outcome is generated and the corresponding multiple payout tiers are identified, a reel combination for the payout tier having priority would be displayed to the user first. At this time, the user would have an option of accepting that reel combination and its associated payout or, alternatively, pressing a button upon the slot machine to select the second payout tier and its displayed indicia. If the user elected to update the first displayed reel combination, at this time, the slot machine would display the reel combination corresponding to the second payout tier. In this manner, an increased degree of chance and excitement would be added to the game since each payout tier identified by the generated outcome would payout a different amount and the user would never know if the second payout tier were higher.

As a further alternative, the present invention could be implemented within a slot machine which displays the possible payouts and related odds for each game. This system would provide a way to modify the odds (by changing the size of each subset) and potential payout between games based upon the most recent games played. For instance, it may be preferable to modify the odds to make it harder to obtain a larger payout immediately after a large payout has been issued. Similarly, it may be desirable to make it easier to obtain a large payout after multiple games have been played without any significant payouts. These odds and the potential payouts would be displayed upon the slot machine in order to further induce players to chose a particular slot machine. The odds in the instant system would be easily changed between games by merely updating the range of each subset corresponding to the outcome identifiers and updating the payout for each win/loss tier. For instance, if an outcome within the second tier is chosen, it may be desirable to reduce the size of the subset of outcome identifiers corresponding to the first and second winning tiers, while increasing the size of the subset of outcome identifiers corresponding to the lower winning tiers.

Further, it may be desirable to change these odds in accordance with the time of day in order to provide worse odds of a large payout during peak playing time periods, and better odds of a large payout during inactive playing time periods.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings 1–5 is to be interpreted as illustrative, and not in a limiting sense.

We claim:

1. An apparatus for determining an outcome of a game, said gaming apparatus comprising:

memory means for storing a plurality of possible outcomes divided into multiple subsets, each subset including a win/loss tier and at least one series of indicia;

generating means for generating a random number;

scaling means for scaling said ransom number by a factor other than one to obtain an outcome identifier from a plurality of outcome identifiers, said outcome identifier designating a resulting outcome;

assigning means for assigning a plurality of outcome identifiers to corresponding win/loss tiers representing amounts to be paid out;

determining means for determining a resulting win/loss tier and payout and for determining a resulting series of indicia to be displayed based directly upon said outcome identifier; and displaying means for displaying the resulting series of indicia corresponding to said resulting win/loss tier.

2. An apparatus for determining an outcome of a game, according to claim 1, wherein said memory means stores multiple tables, each of said tables including at least one unique series of indicia to be displayed, each table corresponding to one of said win/loss tiers.

3. An apparatus for determining an outcome of a game, according to claim 2, wherein said multiple tables include at least one table consisting of a single series of indicia representing an only reel combination to be displayed for a corresponding resulting outcome and at least one table including more than one series of indicia representing more than one reel combination to be displayed for a corresponding resulting outcome.

4. An apparatus for determining an outcome of a game, according to claim 1, wherein said memory means stores multiple reel combination tables and a one-to-one relationship between each of said subsets and a corresponding reel combination table, each reel combination table storing at least one unique series of indicia to be displayed.

5. An apparatus for determining an outcome of a game, according to claim 1, wherein said memory means stores upper and lower limits for each subset and wherein said determining means compares said outcome identifier to said upper and lower limits to determine said resulting win/loss tier.

6. An apparatus for determining an outcome of a game, according to claim 1, wherein said scaling means includes first scaling means for scaling said random number by a total number of possible outcomes to obtain said outcome identifier.

7. An apparatus for determining an outcome of a game, according to claim 1, wherein said scaling means includes second scaling means for scaling said random number by a total number of series of indicia corresponding to said resulting win/loss tier to identify a single series of indicia to be displayed.

8. An apparatus for determining an outcome of a game, according to claim 1, wherein said determining means produces a reel combination index based on said outcome identifier and uses said reel combination index to obtain a series of indicia to be displayed.

9. An apparatus for determining an outcome of a game, according to claim 8, wherein reel combination index represents a scaled value of said outcome identifier.

10. An apparatus for determining an outcome of a game, according to claim 1, further comprising means for determining and distributing a payout award based on said resulting win/loss tier during every game.

11. An apparatus for determining an outcome of a game, according to claim 1, wherein said memory means stores upper and lower limits for each subset, said memory means varying a probability of occurrence for each win/loss tier by changing said upper and lower limits.

12. An apparatus for determining an outcome of a game, according to claim 1, wherein said memory means stores a one-to-one relationship between said outcome identifier and a corresponding one of said plurality of possible outcomes.

13. An apparatus for determining an outcome of a game, according to claim 1, wherein said display means displays multiple rows and columns of indicia which include said resulting series of indicia aligned to identify said resulting outcome.

14. An apparatus for determining an outcome of a game, according to claim 13, wherein said display means aligns said resulting series of indicia identifying said resulting outcome along one of a horizontal, vertical and any other combination of visible reel positions.

15. An apparatus for determining an outcome of a game according to claim 1, wherein at least one of said win/loss tiers corresponds to at least two unique series of indicia, each of said series of indicia being identified by a different outcome identifier.

16. An apparatus according to claim 1, wherein said determining means determines said resulting win/loss tier independent of said resulting series of indicia displayed by said display means.

17. An apparatus according to claim 1, wherein said determining means determines said resulting win/loss tier including said payout prior to said display means displaying said resulting series of indicia.

18. A method for determining an outcome of a game said method comprising the steps of:

providing a plurality of possible outcomes, said outcomes being divided into multiple subsets;

assigning each subset to a win/loss tier and to at least one series of indicia;

generating a random number;

scaling said random number by a factor other than one to obtain a random outcome identifier from a plurality of outcome identifiers;

assigning a plurality of outcome identifiers to corresponding win/loss tiers representing amounts to be paid out;

determining a resulting win/loss tier and a resulting series of indicia based directly upon said outcome identifier; and displaying the resulting series of indicia corresponding to said outcome identifier.

19. A method for determining an outcome of a game, according to claim 18, further comprising the step of storing multiple tables accessed in said determining step, each table storing at least one unique series of indicia to be displayed, each table corresponds to one of said win/loss tiers.

20. A method for determining an outcome of a game, according to claim 19, wherein said step of storing multiple tables includes storing at least one table containing a single series of indicia representing an only reel combination to be displayed for a corresponding possible outcome and storing at least one table containing more than one series of indicia representing more than one reel combination to be displayed for a corresponding possible outcome.

21. A method for determining an outcome of a game, according to claim 18, wherein said plurality of outcome identifiers represent a plurality of integers separated into said multiple subsets, said subset assigning step including providing a one-to-one relationship between each of said subsets and a corresponding reel combination table, each reel combination table storing at least one unique series of indicia to be displayed.

22. A method for determining an outcome of a game, according to claim 18, wherein said determining step includes comparing said generated outcome identifier to upper and lower limits of each of said multiple subsets and determining within which of said upper and lower limits said outcome identifier falls to determine said corresponding resulting win/loss tier.

23. A method for determining an outcome of a game, according to claim 18, wherein said scaling step includes the step of scaling said random number by a total number of possible outcomes to obtain said outcome identifier.

24. A method for determining an outcome of a game, according to claim 18, wherein said scaling step includes the step of scaling said random number by a total number of said series of indicia corresponding to said resulting win/loss tier to identify said resulting series of indicia to be displayed.

25. A method for determining an outcome of a game, according to claim 18, wherein said determining step includes: producing a reel combination index based on said outcome identifier and obtaining a series of indicia to be displayed based on said reel combination index.

26. A method for determining an outcome of a game, according to claim 24, wherein said reel combination index represents a scaled value of said outcome identifier.

27. A method for determining an outcome of a game, according to claim 18, further comprising the steps of determining and distributing a payout award based on said resulting win/loss tier corresponding to said outcome identifier.

28. A method for determining an outcome of a game, according to claim 18, further comprising the step of varying a probability of occurrence for each win/loss tier by changing upper and lower limits of each of said multiple subsets between games based on a result of a last game.

29. A method for determining an outcome of a game, according to claim 18, further comprising the step of providing a one-to-one relationship between each outcome identifier and a corresponding one of said plurality of possible outcomes.

30. A method for determining an outcome of a game, according to claim 18, further comprising the step of displaying multiple rows and columns of indicia which include a series of indicia aligned to identify a possible outcome.

31. A method for determining an outcome of a game, according to claim 30, further comprising the step of identifying said resulting win/loss tier by aligning said resulting series of indicia identifying a corresponding possible outcome along one of a horizontal, vertical, and any other combination of visible reel positions.

32. A method for determining an outcome of a game, according to claim 18, wherein the step of determining said resulting win/loss tier and said payout occurs before the step of displaying said resulting series of indicia.

33. A method for determining an outcome of a game, according to claim 18, wherein at least one win/loss tier corresponds to at least two unique series of indicia, each of said series of indicia corresponding to a different outcome identifier.

* * * * *

UNITED STATES PATENT AND TRADEMARK OFFICE

CERTIFICATE OF CORRECTION

PATENT NO. : 5,511,784

DATED : April 30, 1996

INVENTOR(S) : Kevin FURRY and Jess TODE

It is certified that error appears in the above-identified patent and that said Letters Patent is hereby corrected as shown below:

Column 10, Line 44, "ransom" should be deleted and -- random -- inserted in its place.

Signed and Sealed this

Nineteenth Day of November, 1996

*Attest:*

Bruce Lehman

BRUCE LEHMAN

*Attesting Officer*

*Commissioner of Patents and Trademarks*